United States Patent [19]

Ogg

[11] Patent Number: 4,469,042

[45] Date of Patent: Sep. 4, 1984

[54] SHANK FOR AN ANCHOR STRUCTURE

[75] Inventor: Robert D. Ogg, Kentfield, Calif.

[73] Assignee: Alpha Ocean Systems, Inc., Kentfield, Calif.

[21] Appl. No.: 387,461

[22] Filed: Jun. 11, 1982

Related U.S. Application Data

[63] Continuation-in-part of Ser. No. 175,766, Aug. 6, 1980, abandoned.

[51] Int. Cl.[3] ..... B63B 21/44

[52] U.S. Cl. ..... 114/304

[58] Field of Search ..... 114/293-310, 114/230; 411/16

[56] References Cited

U.S. PATENT DOCUMENTS

| | | | |
|---|---|---|---|
| 2,669,963 | 2/1954 | Christie | 114/298 |
| 3,024,756 | 3/1962 | Ogg | 114/309 |
| 3,280,783 | 10/1966 | Menning | 114/309 |
| 3,759,212 | 9/1973 | Cluett | 114/309 |
| 4,083,289 | 4/1978 | Erickson | 411/16 |

*Primary Examiner*—Trygve M. Blix
*Assistant Examiner*—Jesûs D. Sotelo

[57] ABSTRACT

A novel shank is provided for an anchor which greatly improves the retention capacity of the anchor. The shank has a tip joined by an intermediate portion to a body portion. These three elements when at rest are in alignment along the longitudinal axis of the shank. The shank is inflexible in a first plane and is flexible in a second plane which is oriented at 90° to the first plane to an extent such that the tip can be moved in the second plane into a position wherein it is substantially normal to the longitudinal axis without permanent deformation of the shank.

9 Claims, 7 Drawing Figures

SHANK FOR AN ANCHOR STRUCTURE

REFERENCE TO RELATED APPLICATION

This application is a continuation-in-part of my application Ser. No. 175,766 filed Aug. 6, 1980, now abandoned.

BACKGROUND OF THE INVENTION

An anchor generally comprises several elements including ground engaging means usually in the form of one or more planar or curvilinear surfaces usually termed the fluke or flukes. Various fluke shapes are shown in patents to Danforth U.S. Pat. Nos. 2,249,546 and 2,674,968, to Ogg U.S. Pat. Nos. 2,711,150, 2,840,029 and 3,024,756, to Bruce U.S. Pat. Nos. 3,777,695 and 4,134,356, to Towne U.S. Pat. Nos. 3,015,299 and 3,783,815 to van den Haak U.S. Pat. Nos. 3,902,446, 3,964,421 and 4,089,288, to Taylor U.S. Pat. No. 1,974,933 and to Klaren U.S. Pat. No. 4,024,090. The fluke or flukes can be solid as in the aforementioned patents or hollow as in the Lenox U.S. Pat. No. 709,914, the Danforth U.S. Pat. No. 2,249,546 and in the POOL anchor of N.V. Koninklijke Nederlandsche Grofsmederij.

In association with the aforementioned fluke surfaces, means are provided to facilitate and maintain the proper engagement of the aforesaid fluke surfaces with the bottom. Such means are usually termed the crown, the latter serving initially to lift the after end of the anchor to force the aforementioned fluke surfaces into bottom engagement.

Extending forwardly from the crown and in advance of such surfaces for attachment to an engaged cable or chain is a socalled shank. Shanks used heretofore have usually been in the form of a heavy, solid rectilinear bar. Various authors have pointed out that, particularly in a harder soil such as sand, penetration of an achor into bottom is limited by the shank which slides over the bottom resisting penetration.

It has long been recognized that deep penetration into bottom is a prime factor in determining the efficiency of an anchor. If the anchor does not penetrate bottom, then the anchor structure merely slides across the bottom and the attempted anchoring is merely an exercise in futility.

To provide stability, one or more elements extending laterally from the fluke or flukes are provided to stabilize the entire anchor structure so that it does not rotate when subject to the pulling action applied to the shank by an attached rode. Such an element is frequently referred to as the stock.

The term "rode" is a nautical word of art commonly used to refer to the means (such as a rope, wire, chain, cable or the like) extended between a water supported object (such as a boat, ship, barge, drydock or the like) and a bottom engaging means such as an anchor, clump (U.S. Pat. No. 709,914) or the like.

SUMMARY OF THE INVENTION

It is in general the broad object of the present invention to provide an improved shank element for an anchor such that the holding power of the anchor structure is increased many fold over that of any anchor structure known heretofore.

The novel shank structure of this invention is such that its resistance to penetration is greatly reduced. It enables the entire anchor structure to penetrate more deeply into any bottom to provide higher holding power and this promptly upon the anchor structure engaging the bottom.

The shank is provided with a tip at one end for attachment to a rode and, at its other end, with a base for attachment to an anchor structure. The base and tip are provided at opposite end of an intermediate portion. The aforementioned three elements of the shank, the base, the tip and the intermediate portion are in axial alignment with one another when the shank is at rest. This axial alignment is referred to as the longitudinal axis of the shank.

The three elements, the tip, the base and the intermediate portion, are of such shape, flexibility and strength that the tip can be pulled by the rode into a position in which the tip attempts to follow and may, in fact, follow the direction of the pull of the rode. When the three elements providing the shank are so pulled by the rode, then the entire shank, in plan view, will be curved to a varying degree by (a) the pull of the rode and (b) the resistance of the anchor structure which is, at least momentarily, fixed in the bottom with which it is engaged. Depending upon the magnitude of the resistance by the bottom engaged by the anchor structure, the shank can be in any one of several curvilinear forms. Such curvilinear forms can vary from that (a) in which the shank, in response to the pull of the rode, has adopted a curved form like that of a flyrod under the stress imposed by a fish being played by the rod, (b) a position in which the forward portion of the shank corresponds to an arc of a circle, (c) any one of various arcuate configurations such as those of a parabolic character, and (d) the position imparted by burial in a very soft bottom such as a soft mud in which the shank is only bent to a slight extent. The shank of this invention is fully capable of movement to approximate any one of these postures by (1) the pull exerted by the rode and (2) the opposition to the pull which opposition is provided by the anchor structure in engagement with the bottom.

Such flexible shank provides several advantages. For example, when the anchor is first engaged with bottom, the flexible shank bends with respect to its longitudinal axis and allows the anchor to penetrate bottom even if it is not exactly following the direction of the pull exerted by the rode. Further, after the anchor has buried, if the anchor is pulled to one side as by the action of a shifting tide on a ship, the flexible shank curves in its attempt to follow the direction of the pull exerted by the rode. This is in contrast with prior art anchors having a stiff shank which, upon application of such a side thrust, upsets the anchor and dislodges the anchor from engagement with the bottom.

Thus, the anchor of the present invention has an improved shank which greatly increases the holding power of the anchor since the flexible shank does not ride over the bottom but, instead, buries in the bottom and assists the anchor structure in penetrating bottom. Further, being very flexible, the shank of the present invention flexes so that a force from the side does not immediately dislodge the anchor from engagement with the bottom. In addition, the shank is much stronger than the conventional shank which usually breaks or permanently deforms if subjected to an excessive force from the side.

To summarize what is important is that the shank is (1) of such flexibility and (2) of such strength that the shank can bend to the extent required to accommodate the extent that the pull exerted by the rode exceeds the resistance provided by the anchor structure of which the shank is a part. The concept of an anchor shank which is (1) of such flexibility and (2) of such strength as to permit of its bending by the excess of the pull of the rode over the static pressure of that portion of the anchor structure engaged with the bottom is absent from any prior teaching or any prior use.

Other features and objects of the invention will be as set forth in the following description of the best mode of practicing the invention.

Under the heading - Factors re Shank Design - two criterions which I have found important in providing a shank having the required strength and flexibility are set forth.

BRIEF DESCRIPTION OF THE DRAWINGS

FIG. 7 is a diagrammatic view illustrating the Factors re Shank Design.

DESCRIPTION OF THE PREFERRED EMBODIMENT

Figure 1:
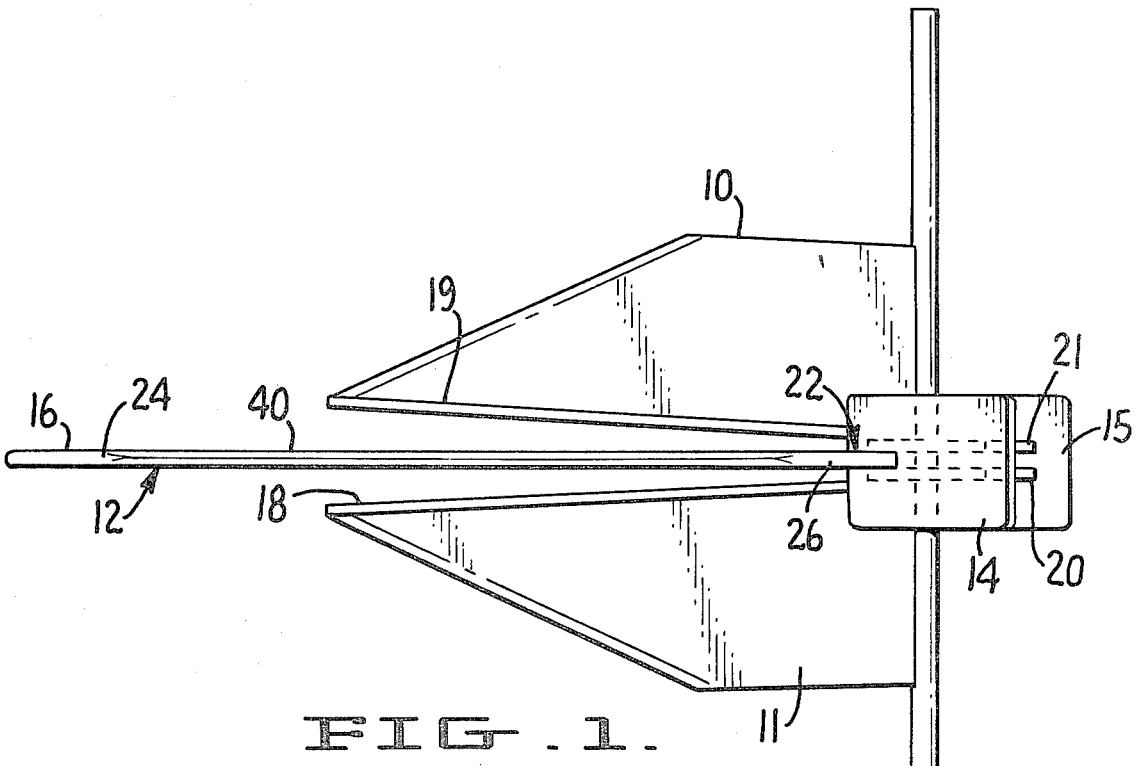
FIG. 1 is a plan view of one form of an anchor embodying the present invention.
Figure 2:
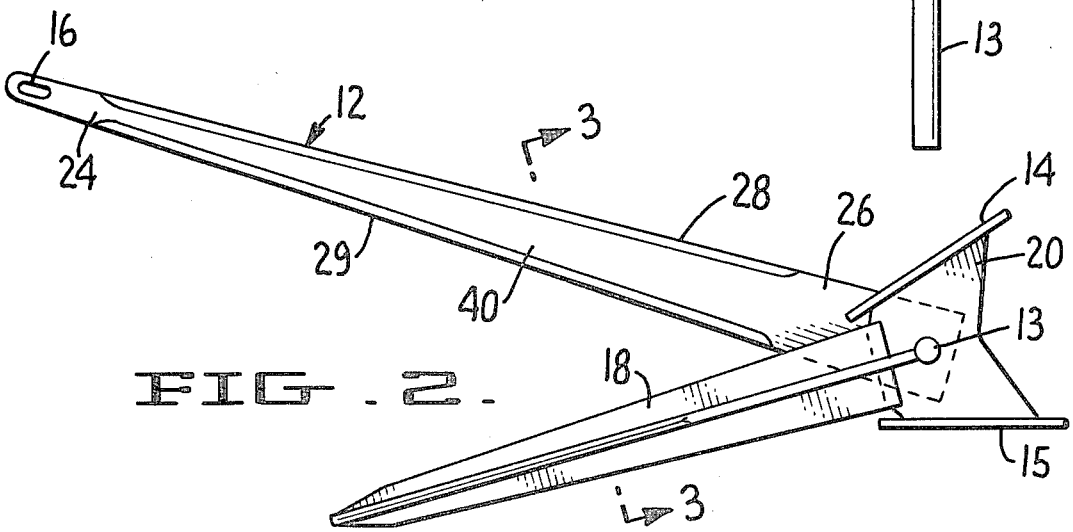
FIG. 2 is a side view of the anchor shown in FIG. 1.
Figure 3:
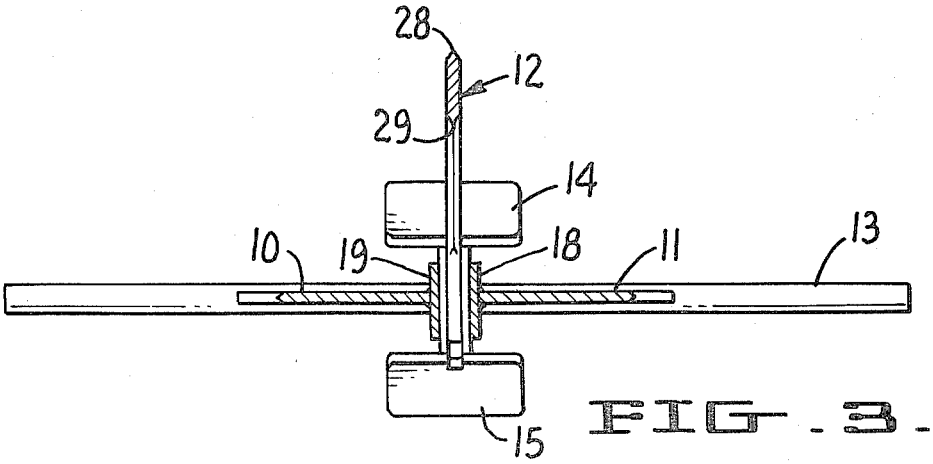
FIG. 3 is a view, partly in section, taken on the line 3—3 of FIG. 2.

In FIGS. 1 through 3 an embodiment of an anchor is shown which includes flukes 10 and 11, shank 12, stock 13 and opposite crown plates 14 and 15. Intermediate portion 40 of the shank 12 (FIG. 2) tapers in side elevation between the base end 26 of the shank and its tip end 24. The flukes are secured in a co-planar relationship on either side of the shank 12, the latter having an eye 16 at its forward end for attachment to a rode such as is provided by any of the aforementioned means. The edges of the shank can be sharpened as at 28 and 29 to aid penetration by lowering the resistance to penetration and burial of the shank.

The flukes 10 and 11 have reinforcing ribs 18 and 19 formed on the flange edge nearest the shank. Each rib is secured to one of spacer plates 20 and 21 provided on each side of the shank. These confine the shank to its position on the stock 13 and support the crown plates 14 and 15. Each crown plate may be relieved as at 22 to permit the desired swing of the shank; the swing of the fluke or flukes is generally termed the fluke angle. In an anchor structure intended for use primarily in hard sand a favorable fluke angle is about 33°, while a favorable fluke angle for an anchor structure for use in soft mud is about 55°.

Figure 4:
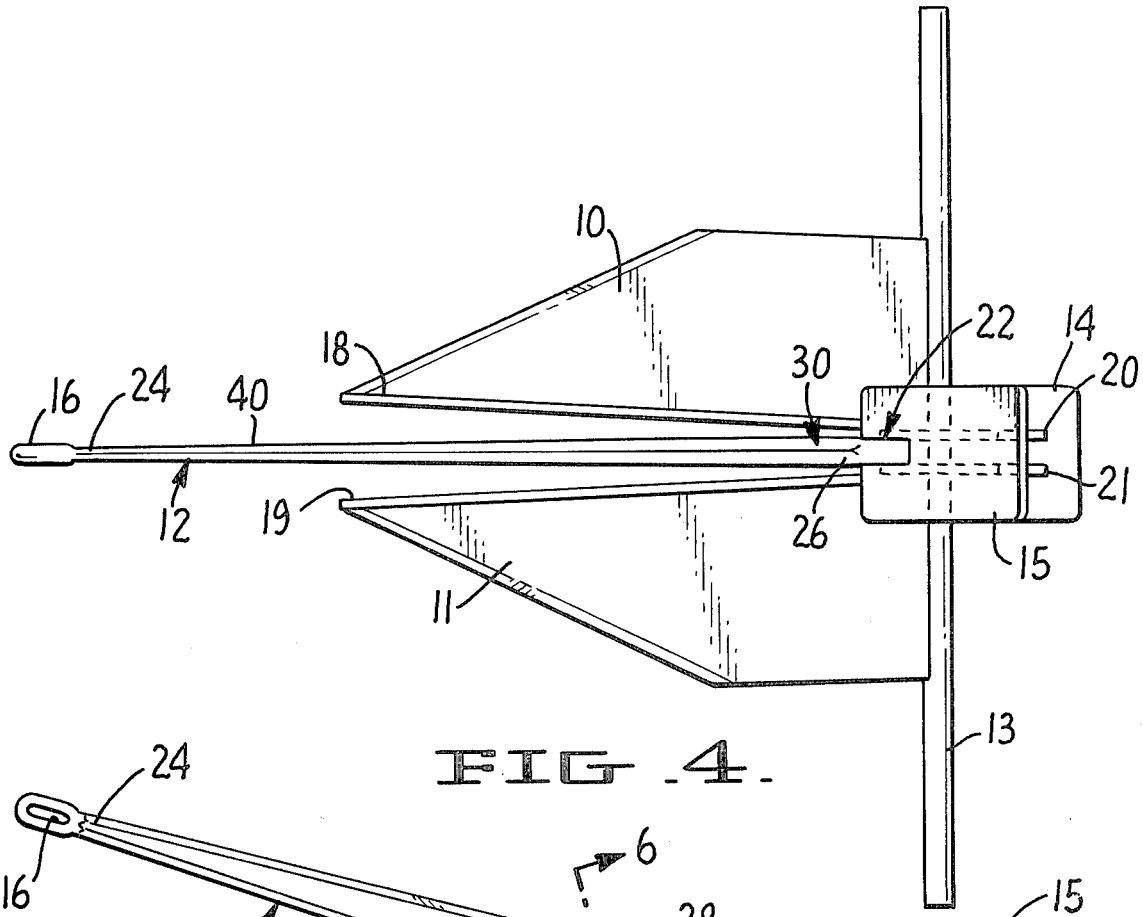
FIG. 4 is a plan view of another form of an anchor embodying the present invention.
Figure 5:
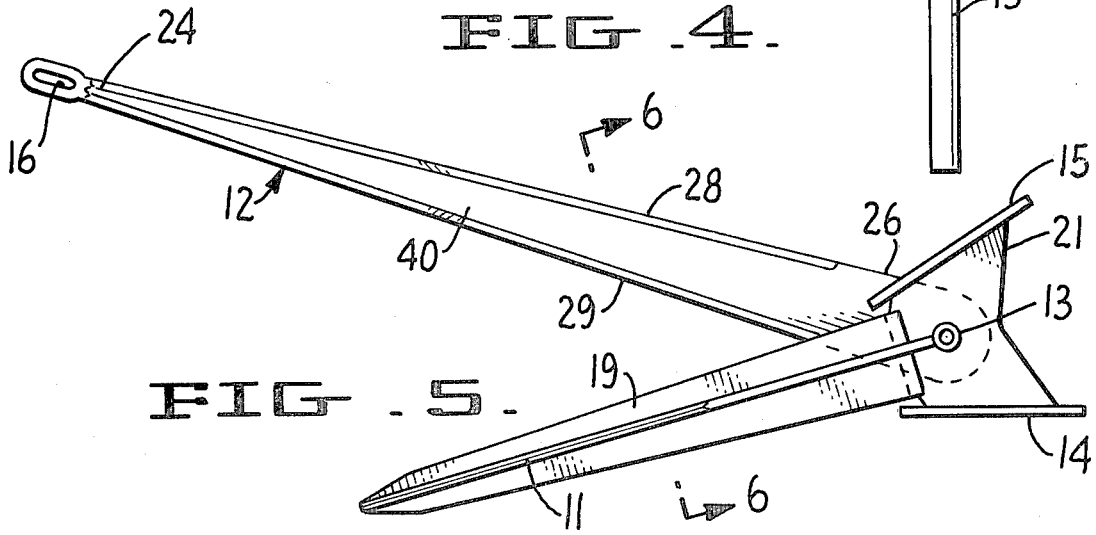
FIG. 5 is a side elevation of the anchor shown in FIG. 4.
Figure 6:
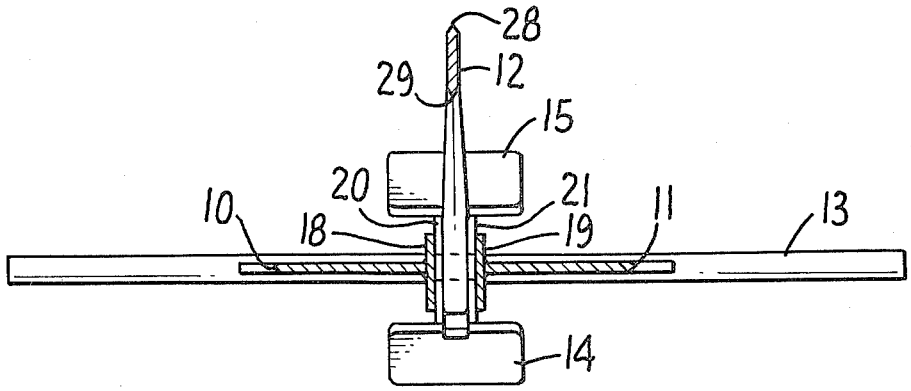
FIG. 6 is a view, partly in section, taken along the line 6—6 of FIG. 5.
Figure 2:
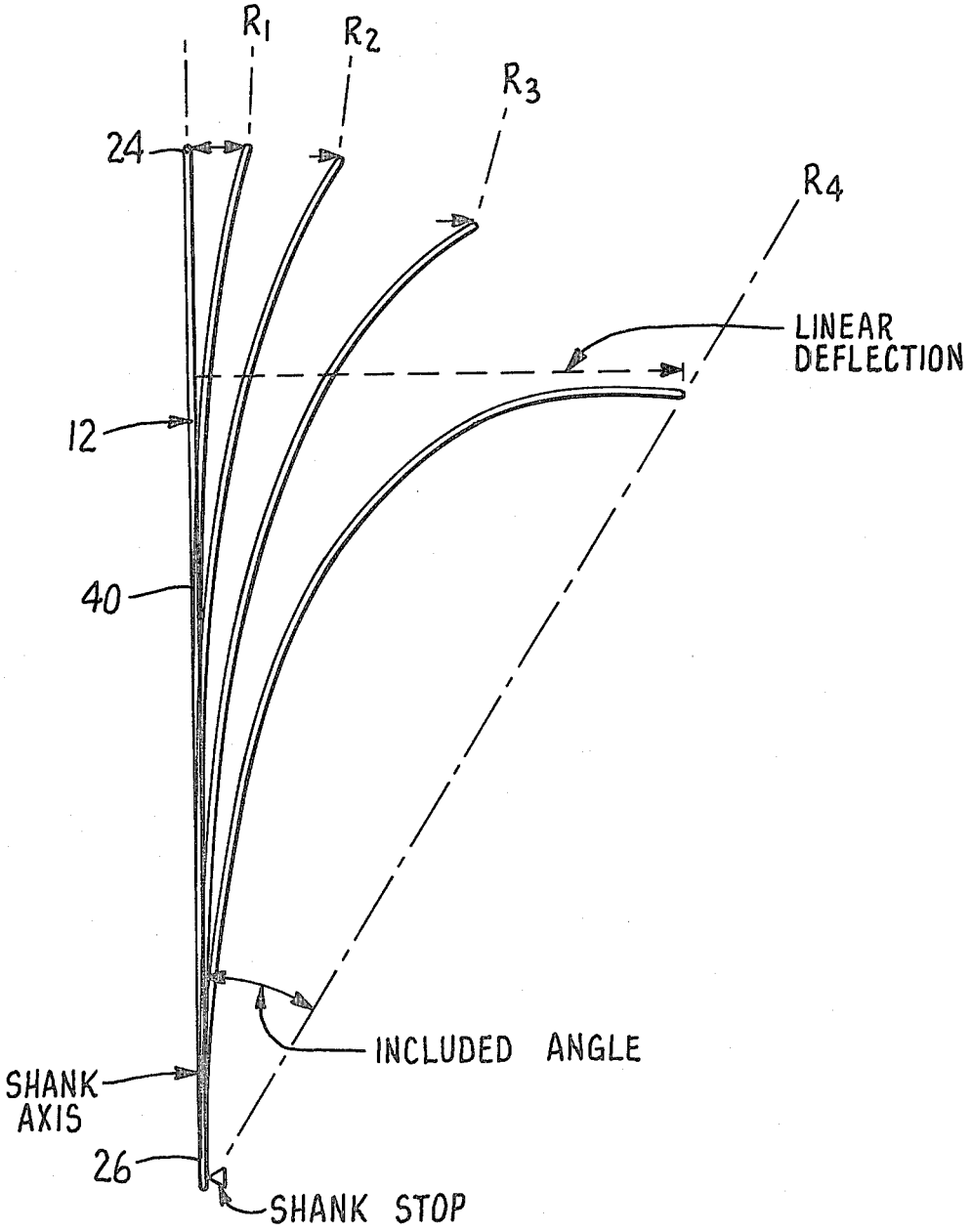

In that form of the invention shown in FIGS. 4–6 the shank tapers in thickness as at 30 from its tip end 24 to its base end 26. This is in contrast to the shank shown in FIGS. 1–3 which tapers only in its side elevation from its tip end 24 to its stock end 26. The numerals applied to the structure of FIGS. 1–3 are applied to like elements in FIGS. 4–6.

The dimensions and the material of the shank must be selected so that the flexibility is achieved without exceeding the limit of the elasticity of the shank, i.e., upon release of pressure, the shank must return to substantially its unstressed position at right angles to the stock.

The shank can be regarded as a single leaf cantilever spring and can be made from any one of the various fine grain alloy steels, e.g. a spring steel having a yield strength of the order of 200,000 pounds per square inch, or a high carbon alloy steel. When it is desired to provide a shank manufactured by forging or by casting, a flexible material such as nodular graphite can be utilized.

One can also use a fiber-reinforced plastic as produced by Union Carbide Corporation, 3M and Hexcel. A process for producing such material is set forth in the Rohl et al. U.S. Pat. No. 3,462,289 of Aug. 19, 1969. One can also utilize KEVLAR, a product of E. I. du Pont de Nemours and Company of Wilmington, Delaware. KEVLAR is a solid resinous material containing an aromatic polyamide, a fluorocarbon polymer and a polyamide, see Matray U.S. Pat. No. 3,356,760. The manufacture of composites from a fiber-reinforced plastic is well-known and is described fully in both the patent art and in the literature, see, for example, "Science," Vol. 208 for May 23, 1980, pages 832–840.

FIGURES RE SHANK DESIGN

Two criterions of importance in design of the shank are the "included angle" and the "linear deflection."

The included angle is that angle between (1) a line drawn through the tip of the shank and that point on the longitudinal axis of the shank at which curvature of the shank commences and (2) the longitudinal axis of the shank when the shank is at rest. This angle is shown in FIG. 7 for various angular values.

The linear deflection is the distance between (1) the shank tip and (2) the longitudinal axis of the shank at rest, the distance being measured along a line normal to the shank. This dimension is also shown in FIG. 7.

When the shank is made of any one of the aforementioned materials, the deflection can be expressed as a function of the shank length. Thus, with the shank at an included angle of 45° to the longitudinal axis of the shank when the shank is at rest, I have found that the shank is capable of such deflection that its tip or forward end is spaced linearly from the longitudinal axis of the shank a distance which is about 60% of the shank length without any adverse effect such as breaking or the imparting of a permanent set.

The shanks used heretofore were incapable of any deflection of the order of 60%. At the most their deflection without failure did not exceed a few percent, at the most 5%. This deflection was at an included angle of only a few degrees, usually less than 5°. Any deflection of a prior art shank beyond either of the foregoing limits resulted in a failure by breakage or imparting of a permanent set.

THE INCREASE IN RESISTANCE TO CONTINUED BURIAL

U.S. Pat. No. 2,249,546 contains a comparison of the resistance to continued burial of several anchors then available on the commercial market (1940) with the anchor which was the subject of that patent. The resistance was given under a heading "holding power per pound weight." That value ranged from 2.0 to 206.9. Mention was also made of a 29 pound anchor whose resistance was such that a $\frac{3}{8}$" chain rated at 8,000 pounds tensile strength, failed under continued pull. Under these conditions, the resistance was of the order of 275 pounds per pound of anchor weight. The tests reported in that patent were made in certain areas of San Francisco Bay. In tests made in the same areas utilized in the earlier reported tests and under like conditions, an anchor made in accordance with this invention provided a resistance to burial of 1,500 pounds and more per pound of anchor weight.

The significance of that unexpected increase in burial resistance per unit of anchor weight is believed to be of great importance to every anchor user. In the small boat field, it enables a boat user to anchor safely with greater ease and convenience in the handling of the anchor before and after mooring. At the other extreme, for example, in the offshore drilling field where the weight of the anchor is measured in tons rather than in pounds, the difficulties in the placement of such immense anchors are materially reduced.

The anchor of U.S. Pat. No. 2,249,546 was a great advance in the anchor art. This was attested to by the governments of the United States, Great Britain and the Netherlands for each purchased a license under that patent. The contributions of the teachings of that patent were recognized in an article which appeared in LIFE, a national weekly publication in the '30s, '40s and '50s. The article was published soon after the cessation of hostilities in World War II. The gist of the article was that the anchor of the Danforth patent had made possible the successful use of landing craft for the delivery of men, machinery and supplies to the beaches in all war zones involved in that conflict.

In carrying out the so-called landing craft program, each craft carried an anchor of the patented design at its stern. As the craft approached a landing on a beach, the anchor was dropped to engage bottom and a strain was maintained on the anchor cable to insure that the bow of the craft was directed toward the beach, thus avoiding broaching of the craft. When the delivery of the cargo of the craft had been completed, the craft pulled itself free of the beach and this without regard to the tidal condition existing. This freed the beach for the landing of other crafts and made the unloaded craft less likely to enemy air attack. The usual weight of the anchors employed on the landing crafts varied with the size of the craft and was from 100 to 3,000 pounds. With the anchor of this invention, this weight can be substantially reduced, lightening the load on the craft and materially reducing the weight of metal required for the anchors in the overall operation.

THE ANCHOR CONSTRUCTION AND TESTS

Anchors embodying this invention were constructed as taught in the Danforth U.S. Pat. No. 2,249,546 with the exception of the shank; it was constructed to embody this invention. Basically, each shank was made of a suitable thin, flexible and resilient high tensile steel which, after being formed to the desired tapered configuration, was heat treated to provide shanks of the following dimensions, which are in inches:

| SHANK NUMBER | THICKNESS | LENGTH | HEIGHT AT TIP END | HEIGHT AT BASE END |
|---|---|---|---|---|
| 3 | 5/32 | 19 | 3/16 | 2½ |
| 8 | ¼ | 31 | 9/32 | 4 |
| 20 | 13/32 | 49 | 7/16 | 5 7/16 |

Each shank was quite resilient and flexible and was easily moved into a position wherein the shank tip had the linear deflection in inches shown in the following table; the included angle is also shown in degrees. To effect this movement, the base of each shank was firmly held as if attached to an anchor. A pull was then applied to the shank tip to bend the shank to a desired extent. Upon release of the applied pull, each shank returned to its normal straight-line position. No breakage or permanent set occurred.

| SHANK NUMBER | LINEAR DEFLECTION | PERCENT OF LINEAR DEFORMATION/ SHANK LENGTH | INCLUDED ANGLE |
|---|---|---|---|
| 3 | 12½" | 65.8 | 42° |
| 8 | 22" | 71.5 | 46° |
| 20 | 34¾" | 53.3 | 45° |

After performing the foregoing manipulation of each shank, each was then placed in position and secured in those elements necessary to provide a complete anchor, namely, the flukes, a crown and a stock. The three anchors thus provided were of the following weights in pounds:

| ANCHOR | WEIGHT |
|---|---|
| 3 | 4 |
| 8 | 16 |
| 20 | 65 |

Each assembled anchor was then attached to a rode so that the anchor could be engaged with the bottom and then pulled by the force provided by a landing craft; the actual craft was a Navy LCM, capable of exerting a force sufficient to drag the anchor under test, at least 25,000 pounds. A strain gauge was positioned in engagement with the rode to determine the magnitude of the pull required to force the anchor to pass through the layers of solids making up the bottom. With the passage of time, these layers became more compact as the water in which the solids were once suspended is forced from between the solids until they provide a very solid and dense mass. The anchor penetrates the bottom until it reaches a level at which the resistance to further anchor penetration exceeds the applied pulling force.

The three anchors were each attached to a rode which was, in turn, attached to the aforementioned landing craft. Because of a desire to examine each anchor after it had been pulled by the landing craft, none was pulled to the point where it was dragged. It was feared that an anchor might be destroyed by application of a force of the magnitude required to break the anchor free so it could be dragged. In any case, the maximum force exerted upon each anchor while it was still stationary in the bottom is shown in the following table as is the pounds of resistance per pound of anchor weight.

| ANCHOR | TOTAL WEIGHT - POUNDS | MAXIMUM OF EXERTED FORCE - LBS | POUNDS RESISTANCE PER POUND OF WEIGHT |
|---|---|---|---|
| 3 | 4 | 6,000 | 1,500 |
| 8 | 16 | 16,000 | 1,000 |
| 20 | 65 | 40,000 | 615 |

While the three anchors tested were of a nominal weight, the test results are truly indicative of what can be expected in anchors of a greater size and weight.

Those skilled in the art can readily determine the dimensions required for larger size anchors. This has proven to be true in the anchors made under U.S. Pat. No. 2,249,546 in sizes of 10 to 50 and more tons.

The relation of the height of the tip to the height of the base and to the length of the shank is shown in the following table in which (a) is the height of the tip, (b) is the height of the base, and (c) is the length of the shank for the three shanks discussed above.

| SHANK | c/a | c/b | b/a |
|---|---|---|---|
| 3 | 101 | 7.6 | 13.3 |
| 8 | 110 | 7.8 | 14 |
| 20 | 112 | 9.2 | 12 |

The above ratios can vary between 80 to 130 for the length of the shank to the height of the tip end, from 5 to 10 for the ratio of the shank length to the height of the base end and from 10 to 15 for the ratio of the height of the base end to the height of the tip end. The taper of the shank is preferably within these limits.

THE DEVICES WITH WHICH THE SHANK CAN BE EMPLOYED

While the improved shank has been disclosed with some specific references to the anchors disclosed in Danforth and Ogg patents, such reference is without any limitation of the disclosure because the novel shank can be employed with any structure useful to secure in place any water borne object attached by a rode to a device engaged with a bottom and which device restrains or limits the movement of the object with respect to the water supporting the object. In connection with the above, reference is made to each of the aforementioned patents as well as the various anchors disclosed in the several publications by the applicant herein, entitled Anchor and Anchoring, and on deposit in the Library of Congress, including Copyright No. A129402 and later editions.

Summarizing the above, the shank has a tip joined by an intermediate portion to a body portion. The aforementioned three elements when at rest are in alignment along the longitudinal axis of the shank, the shank being inflexible in a first plane and flexible in a second plane which is oriented at 90° to the first plane. The shank is flexible to an extent such that the tip can be moved in the second plane into a position wherein it is substantially normal to the aforementioned longitudinal axis without permanent deformation of the shank.

I claim:

1. In an anchor, a thin, flexible and resilient shank having a tip end and a base end for attachment in an anchor, the shank when at rest having a horizontal plane and a vertical plane normal to the horizontal plane, the shank being inherently rigid in said vertical plane and capable of flexing in a horizontal plane throughout its length until the tip is at a substantial included angle of 5° or more to said vertical plane without causing permanent deformation of said shank.

2. A thin, flexible and resilient anchor shank as in claim 1 fashioned from spring steel.

3. A shank as in claim 1 wherein the ratio of the length of the shank between the tip end and the base end to the height of the tip end ranges from 80 to 130, the ratio of said length of the shank to the height of the base end ranges from 5 to 10, and the ratio of the height of the base end to the height of the tip end ranges from 10 to 15.

4. A thin, flexible and resilient anchor shank having a tip for attachment to a rode and a base for attachment to an anchor structure, the flexibility and the strength of the shank being such that when the shank base is attached to an anchor structure the tip can be pulled horizontally by an attached rode into a position wherein the shank bends freely in a horizontal plane with respect to the attached anchor structure and the tip attempts to align itself with the direction of the pull exerted by an attached rode, said bending being at an included angle of at least 5° and said shank flexing without effecting any permanent deformation or breaking thereof.

5. An anchor shank as in claim 4 fashioned from a thin, flexible and resilient fiber-reinforced plastic.

6. An anchor shank as in claim 4 fashioned from a thin, flexible and resilient material comprising an aromatic polyamide, a fluorocarbon polymer and a polyamide.

7. A thin, flexible and resilient anchor shank as in claim 4 of such strength and flexibility that when in use and under the pull exerted by a rode attached to said shank the shank is capable of curving to an included angle of the order of 45° and a linear deflection of the order of 60% of the length of said shank.

8. An anchor shank having a tip and a base joined by an intermediate portion which are normally in alignment along a longitudinal axis extending from said tip to said base wehn the shank is at rest, the shank being inflexible in a first plane and flexible in a second plane which second plane is oriented 90° with respect to said first plane, said shank being flexible to an extent such that the tip can be moved in said second plane with respect to the base into a position wherein it is substantially normal to the aforementioned longitudinal axis without causing permanent deformation of said shank.

9. In an anchor, a flexible shank having a forward end and an after end which (a) tapers from its after end to its forward end, (b) is inherently rigid in a first plane extending from an unflexed forward end to the after end, and (c) is inherently capable of flexing in a second plane which second plane is oriented 90° with respect to said first plane throughout its length until the forward end is substantially normal to the thus defined first plane without causing permanent deformation of said shank.

* * * * *